US006289856B1

(12) United States Patent
Noguchi

(10) Patent No.: US 6,289,856 B1
(45) Date of Patent: Sep. 18, 2001

(54) STRATIFIED SCAVENGING TWO-CYCLE ENGINE

(75) Inventor: Masanori Noguchi, Higashimurayama (JP)

(73) Assignees: Komatsu Zenoah Co.,, Kawagoe; Petroleum Energy Center, Minato-ku, both of (JP)

( * ) Notice: Subject to any disclaimer, the term of this patent is extended or adjusted under 35 U.S.C. 154(b) by 0 days.

(21) Appl. No.: 09/445,660

(22) PCT Filed: Jun. 4, 1998

(86) PCT No.: PCT/JP98/02478

§ 371 Date: Dec. 10, 1999

§ 102(e) Date: Dec. 10, 1999

(87) PCT Pub. No.: WO98/57053

PCT Pub. Date: Dec. 17, 1998

(30) Foreign Application Priority Data

Jun. 11, 1997 (JP) ..... 9-153927

(51) Int. Cl.[7] ..... F02B 33/00
(52) U.S. Cl. ..... 123/73 PP
(58) Field of Search ..... 123/73 C, 73 PP, 123/65 W, 65 WA, 193.4, 73 A, 193.6

(56) References Cited

U.S. PATENT DOCUMENTS

| | | | | |
|---|---|---|---|---|
| 4,711,201 | * | 12/1987 | Ooyama et al. | 123/73 A |
| 4,809,648 | * | 3/1989 | Luo | 123/73 AA |
| 4,829,940 | | 5/1989 | Okazaki et al. | 123/41.39 |
| 4,995,349 | * | 2/1991 | Tuckey | 123/65 VB |
| 5,189,995 | * | 3/1993 | Hooper | 123/58.6 |
| 5,379,732 | * | 1/1995 | Mavinahally et al. | 123/73 AA |
| 5,628,295 | * | 5/1997 | Todero et al. | 123/568 |
| 5,857,450 | * | 1/1999 | Staerzl | 123/65 S |
| 6,079,379 | * | 6/2000 | Cobb, Jr. | 123/73 B |
| 6,101,991 | * | 8/2000 | Glover | 123/73 PP |
| 6,173,683 | * | 1/2001 | Nemoto et al. | 123/73 PP |

FOREIGN PATENT DOCUMENTS

| | | |
|---|---|---|
| 2650834 A1 | 6/1977 | (DE) . |
| 57-181929 A | 11/1982 | (JP) . |
| 60-194149 U | 12/1985 | (JP) . |
| 63-195368 A | 8/1988 | (JP) . |
| 4-109425 U | 9/1992 | (JP) . |

* cited by examiner

*Primary Examiner*—Noah P. Kamen
*Assistant Examiner*—Hai Huynh
(74) *Attorney, Agent, or Firm*—Sidley Austin Brown & Wood

(57) ABSTRACT

A stratified scavenging two-cycle engine is capable of doing away with emission of a mixture into the atmosphere and of reducing intake resistance of air. For this purpose, an air intake port (11) is provided at a position which is a predetermined distance away from scavenging ports (51) toward a crank chamber (20) parallel to the axial direction of the cylinder block (1), and the scavenging ports (51) are connected to the air intake port (11) through a piston (3) to thereby supply air to scavenging flow passages (50) from the air intake port (11) through the scavenging ports (51) at the time of an intake stroke.

13 Claims, 10 Drawing Sheets

STRATIFIED SCAVENGING TWO-CYCLE ENGINE

TECHNICAL FIELD

The present invention relates to a stratified scavenging two-cycle engine, and particularly relates to a stratified scavenging two-cycle engine which is configured to take in a mixture and scavenging air separately.

BACKGROUND ART

This type of stratified scavenging two-cycle engine conventionally has a scavenging flow passage for connecting a cylinder chamber to a crank chamber; with a mixture flow passage, for supplying a fuel mixture, being connected to the crank chamber; and with an air flow passage, for supplying air, being connected to the scavenging flow passage. A scavenging port of the scavenging flow passage, and an exhaust port of an exhaust pipe are opened to the cylinder chamber. The aforesaid air flow passage is provided with a lead valve (a check valve) 80, shown in FIG. 12, for only allowing the air to flow toward the scavenging flow passage.

In the stratified scavenging two-cycle engine configured as above, a piston 3 ascends, thereby starting to reduce the pressure inside a crank chamber 20 and to increase the pressure inside the cylinder chamber 10; and as the piston 3 ascends, a scavenging port 81 and an exhaust port are sequentially closed. In this situation, a mixture flows into the crank chamber 20 with the pressure therein being reduced, and air from an air flow passage 83 pushes the lead valve 80 open to flow therein through a scavenging flow passage 85.

When the piston 3 reaches the vicinity of the top dead center, the mixture in the cylinder chamber 10 is ignited, and thereafter the piston 3 descends. The piston 3 descends, thereby starting to increase the pressure inside the crank chamber 20; and while the piston 3 is descending, the exhaust port and the scavenging port 81 are sequentially opened, and combustion gas is exhausted via the exhaust port. Subsequently, when the scavenging port 81 is opened, the air remaining in the scavenging flow passage 85 bursts out into the cylinder chamber 10 due to the pressure inside the crank chamber 20. As a result, the combustion gas remaining in the cylinder chamber 10 is expelled. Subsequently, the mixture in the crank chamber 20 is charged into the cylinder chamber 10 through the scavenging flow passage 85. Again, when the piston 3 starts to ascend from the bottom dead center, the pressure inside the crank chamber 20 starts to reduce, and the cycle as described above is repeated once again.

According to the stratified scavenging two-cycle engine configured as above, the inside of the cylinder chamber 10 can be initially scavenged by air, thereby making it possible to prevent the combustible gas from being discharged by the blow-by of the mixture, which provides the advantage that the exhaust gas becomes clean.

However, in the aforesaid stratified scavenging two-cycle engine, as shown in FIG. 12, the air flowing into the scavenging flow passage 85 from the lead valve 80 does not flow into a space 81A in the vicinity of the scavenging port 81, and therefore mixture remains in this space. There exists a disadvantage in that the mixture, together with the air remaining in the scavenging flow passage 85, is discharged from the exhaust port into the atmosphere with the combustion gas via the cylinder chamber 10 when the scavenging port 81 opens in the exhaust stroke in which the piston 3 descends. In addition, the lead valve 80 is provided in the air flow passage 83, thereby causing a disadvantage in that the lead valve 80 becomes intake resistance when air is taken into the scavenging flow passage 85. Further, the number of components is increased due to the lead valve 80, and the structure is complicated, thus causing the disadvantage of increased costs.

SUMMARY OF THE INVENTION

The present invention is made in view of the aforesaid disadvantages, and its object is to provide a stratified scavenging two-cycle engine, which takes in a fuel mixture and scavenging air separately, is capable of doing away with emission of the mixture into the atmosphere by filling a scavenging flow passage with air and reducing intake resistance of air, and is less expensive with the number of components being reduced.

In order to attain the above object, a stratified scavenging two-cycle engine according to the present invention is a stratified scavenging two-cycle engine including an air intake port, scavenging ports, and an exhaust port which are connected to a cylindrical chamber of the engine; a mixture intake port which is connected to a crank chamber; and scavenging flow passages for connecting the cylinder chamber to the crank chamber; and is characterized in that the air intake port is provided at a position which is a predetermined distance away from the scavenging ports toward the crank chamber parallel to axial direction of the cylindrical chamber, and the scavenging ports are connected to the air intake port via the piston to thereby supply air to the scavenging flow passages from the air intake port through the scavenging ports at the time of an intake stroke.

According to the above configuration, the air intake port and the mixture intake port are separately connected to the cylinder chamber and the crank chamber, respectively, and air is supplied to the scavenging flow passages for connecting the cylinder chamber to the crank chamber via the piston, thereby making it possible to fill at least the cylinder chamber side of the scavenging flow passage with air at the time of an intake stroke. In addition, since the air intake port is opened at a lower position which is the predetermined distance away from the scavenging ports toward the crank chamber, when the top portion of the piston opens the scavenging ports at the time of a scavenging stroke, the air intake port is already closed, and therefore neither air nor the mixture flows back to the air flow passage, thus making a lead valve unnecessary.

Accordingly, in the scavenging stroke, the combustion gas can be initially scavenged from the cylinder chamber by means of the air in the scavenging flow passage, and thus the mixture does not flow into the atmosphere. Further, the lead valve for taking air into the scavenging flow passage is not needed, thereby making it possible to reduce the intake resistance of air and the number of components.

Further, the stratified scavenging two-cycle engine can be characterized in that the piston has a channel on the outer perimeter thereof, and the channel connects the scavenging ports to the air intake port and disconnects the mixture intake port from the scavenging ports, at the time of intake stroke.

According to the above configuration, in the intake stroke, since the mixture intake port is disconnected from the scavenging ports, the mixture does not stay in the scavenging flow passages, thus making it possible to fill the scavenging flow passages with air.

Accordingly, in the intake stroke, the combustion gas in the cylinder chamber can be scavenged by means of the air in the scavenging flow passages, and thus the mixture does not leak into the atmosphere.

Furthermore, the stratified scavenging two-cycle engine can be characterized in that the mixture intake port can be opened and closed by the piston.

According to the above configuration, in the scavenging stroke, when the top portion of the piston opens the scavenging ports, the mixture intake port is already closed, whereby the mixture does not flow back to the mixture flow passage, and thus the lead valve can be made unnecessary.

In addition, since the lead valve for supplying the mixture to the crank chamber is not needed, the number of components can be reduced.

BEST MODE FOR CARRYING OUT THE INVENTION

Figure 1:
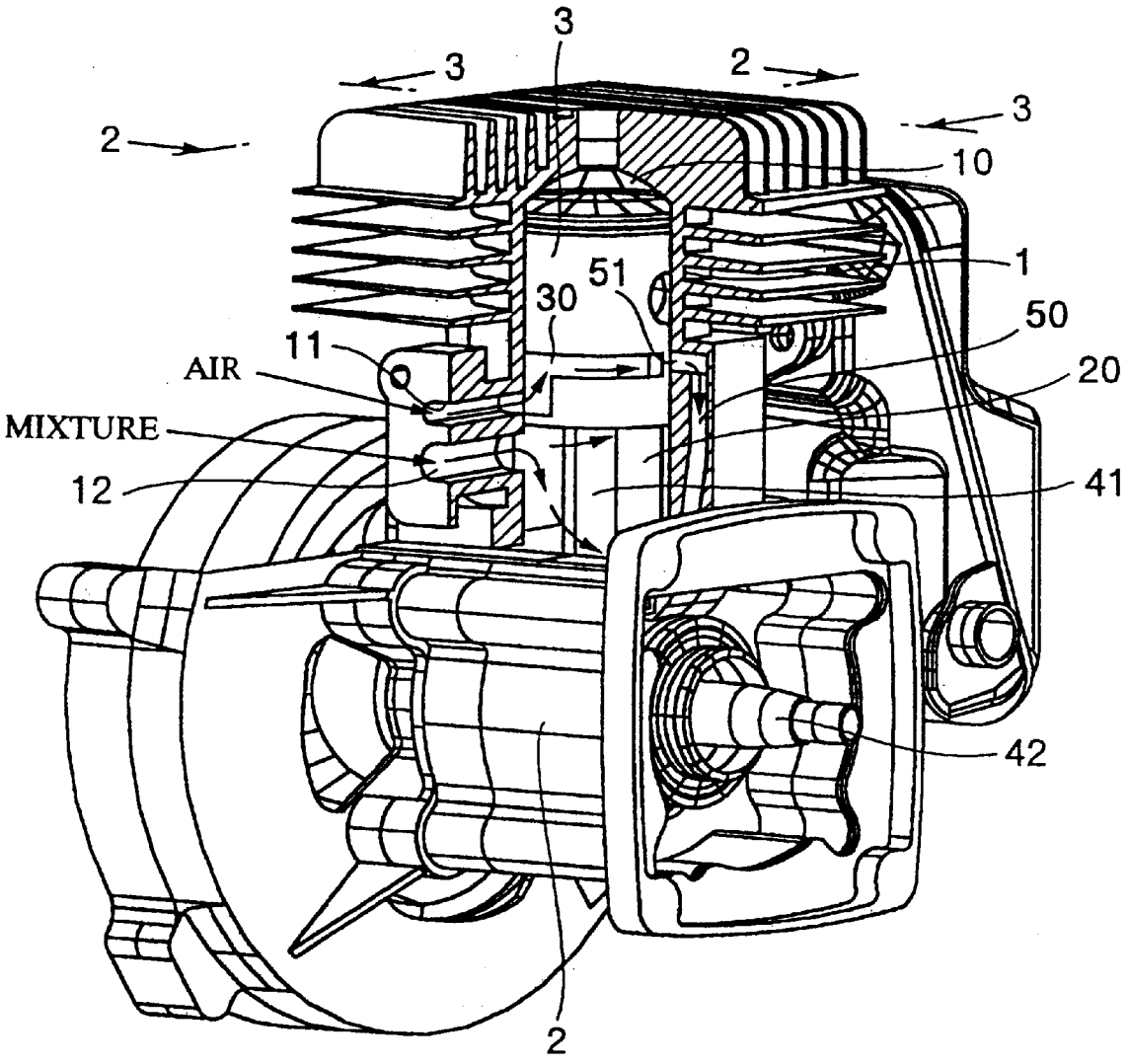
FIG. 1 is a partially cutaway perspective view of a stratified scavenging two-cycle engine of a first embodiment according to the present invention.

Preferred embodiments of the present invention will be explained with reference to FIG. 1 through FIG. 11 below. A stratified scavenging two-cycle engine represented by a first embodiment will be initially shown in FIG. 1 through FIG. 6. In FIG. 1 through FIG. 6, a crankcase 2 is provided at the bottom side of a cylinder block 1. A piston 3 is provided in a cylindrical chamber in the cylinder block 1 so as to be slidably and closely inserted therein, and the piston 3 is connected to a crank 42 in the crankcase 2 via a connecting rod 41. A space with variable volumetric capacity, which is on the top of the piston 3 in the cylinder block 1, is a cylinder chamber 10; and a space, which is under the piston 3 and surrounded by the cylinder block 1 and the crankcase 2, is a crank chamber 20. It should be noted that regarding the aforesaid "closely inserted", a clearance is provided in the illustrations in FIG. 4 to FIG. 6 to facilitate the explanation.

Figure 3:
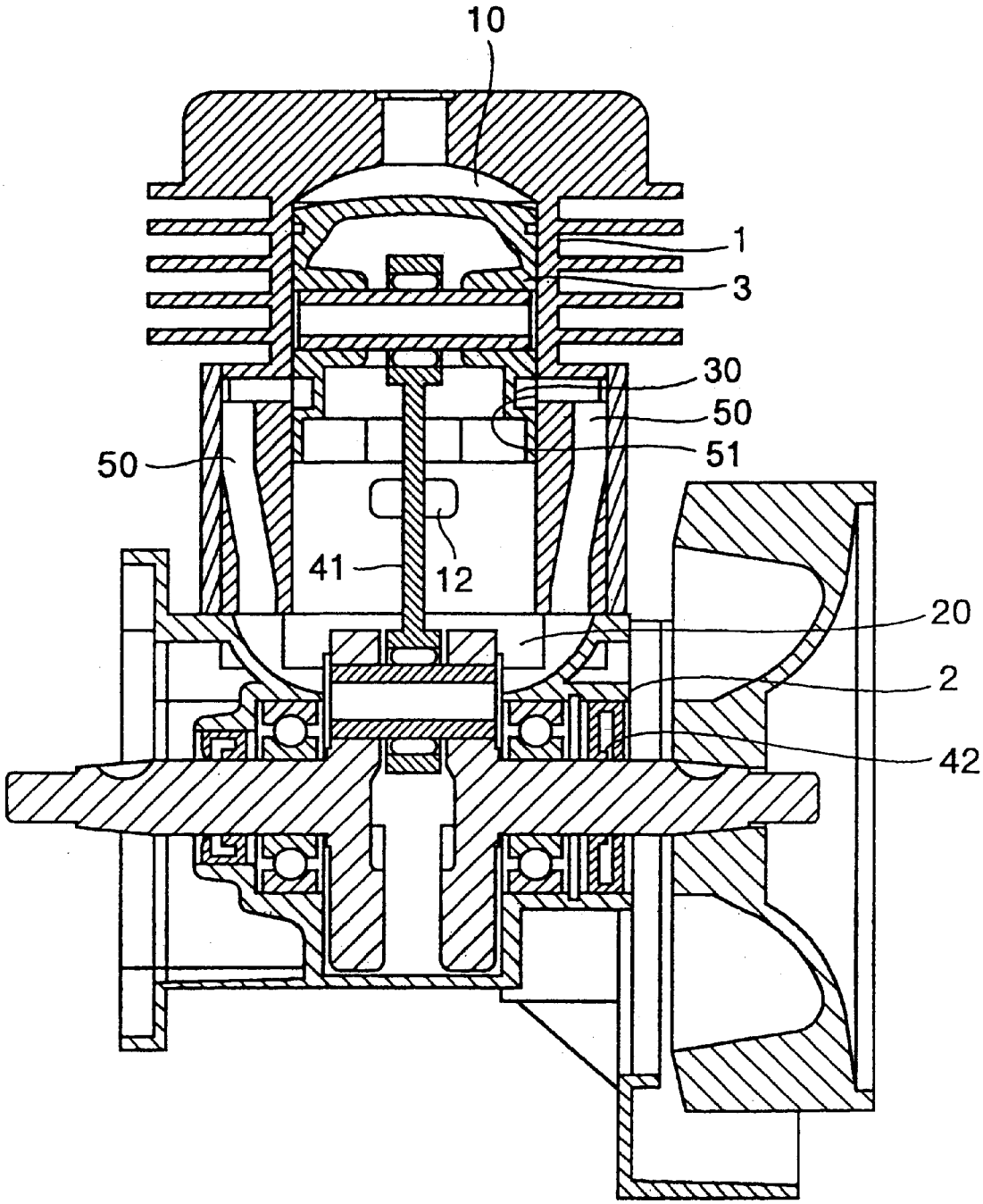
FIG. 3 is a sectional view of the stratified scavenging two-cycle engine of the first embodiment according to the present invention, showing a sectional view taken along the 3—3 line in FIG. 1.
Figure 4:
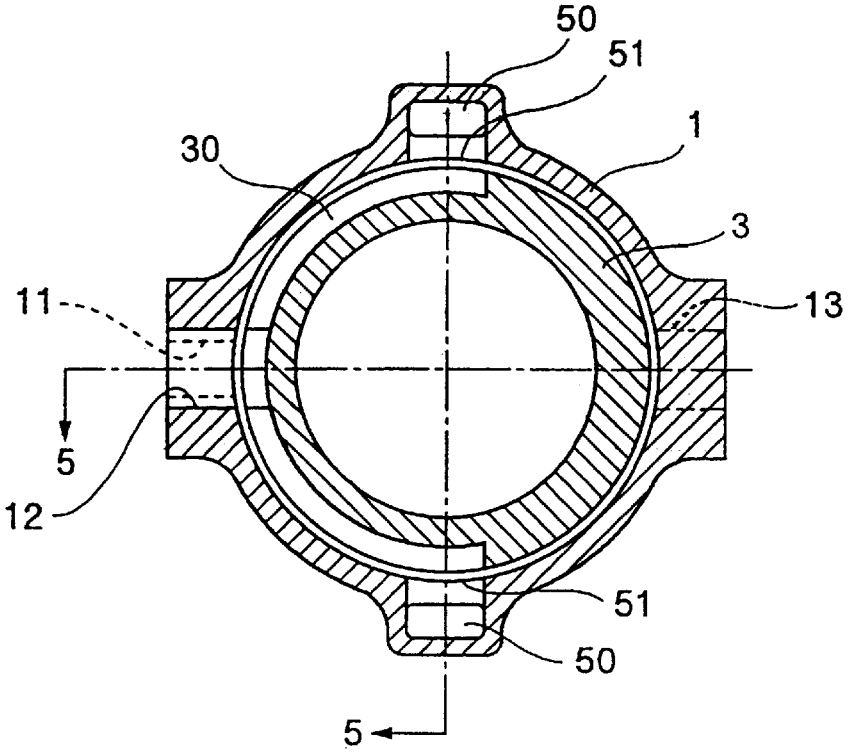
FIG. 4 is a sectional plan view of the stratified scavenging two-cycle engine of the first embodiment according to the present invention, showing a sectional view taken along the 4—4 line in FIG. 5.

Two scavenging flow passages 50, for connecting the cylinder chamber 10 and the crank chamber 20, are provided in the cylinder block 1 and the crankcase 2 as shown in FIG. 3. The scavenging flow passages 50 open into the cylinder chamber 10 (the inner perimeter surface of the cylinder block 1) as scavenging ports 51. An air intake port 11 and a mixture intake port 12 are provided in the inner perimeter surface of the cylinder block 1. The air intake port 11 and the mixture intake port 12 are vertically arranged to be away from each other by a predetermined distance La (see FIG. 5) parallel to the axial direction of the cylindrical chamber in the cylinder block 1. A position at which the air intake port 11 is opened is lower than a position at which scavenging ports 51 are opened by a predetermined distance Lb (see FIG. 5) in the axial direction of the cylindrical chamber in the cylinder block 1. As for the positions at which the scavenging ports 51 are opened, the two scavenging ports 51 are provided at positions which are displaced 90 degrees apart in a direction of the perimeter of the circle as shown in FIG. 4. The positions of the scavenging port 51, however, are not necessarily limited to the angle of 90 degrees, but can be appropriately selected according to the positional relationship between the air intake port 11 and the exhaust port 13, and asymmetrical positions can be selected. Further, the number of the scavenging ports 51 is not limited to two, and only one may be suitable. A width Ba (see FIG. 5) of the opening of the scavenging port 51 parallel to the axial direction is formed to be opened less than the predetermined distance La by which the air intake port 11 is separated from the mixture intake port 12 (the width Ba<the predetermined distance La).

The air intake port 11 is opened and closed by the movement of the piston 3, thereby making it possible to connect it to and cut it off from a channel (passage) 30 formed on the outer perimeter of the piston 3. The channel 30 is formed on the outer perimeter of the piston 3 in a T-shaped form in side view; and in a plan view, it is formed in the semi-circle of the outer perimeter of the piston 3 with a predetermined depth in plan view, as shown in a plan view in FIG. 4 and in a side view in FIG. 5.

Figure 6:
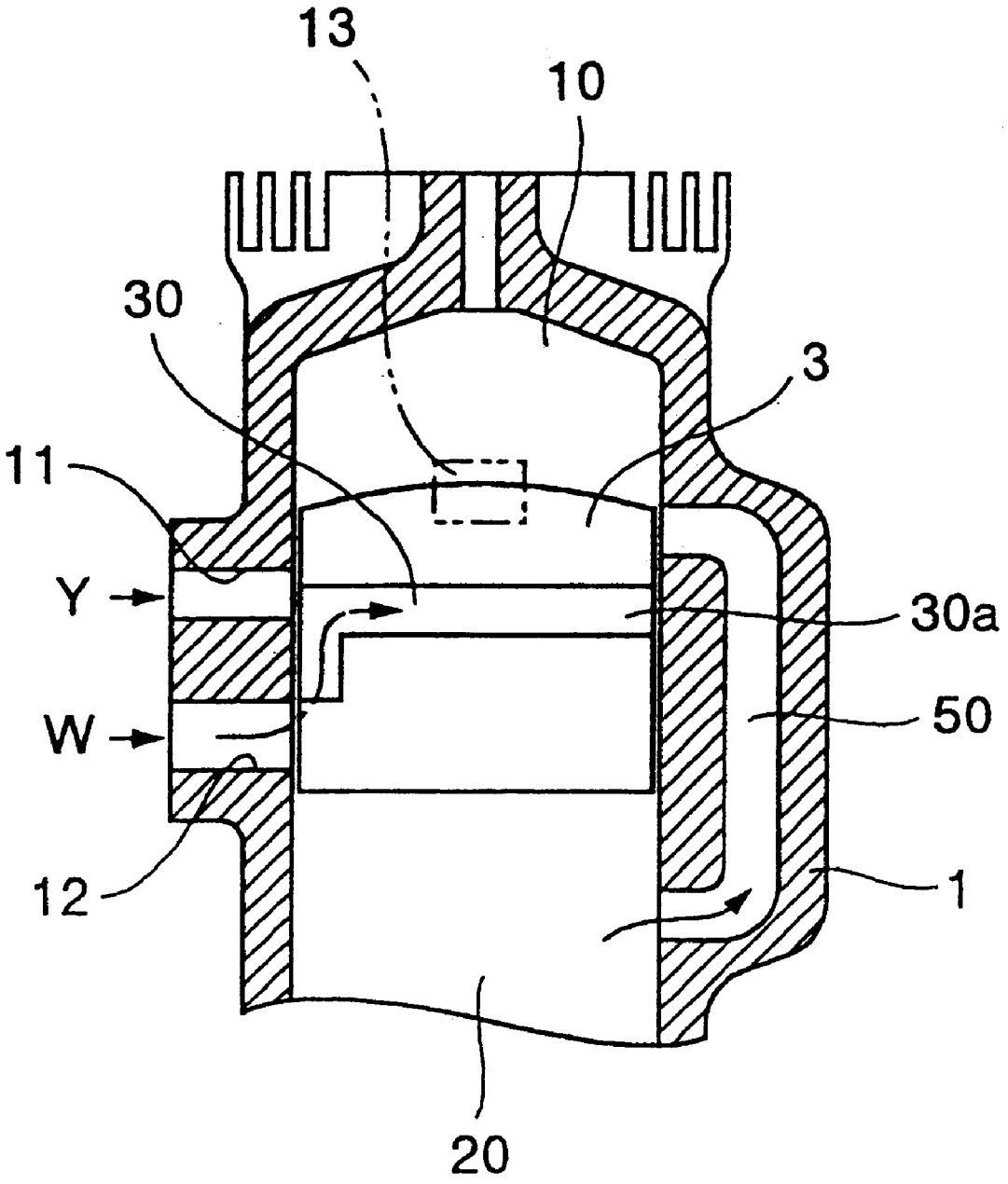
FIG. 6 is a sectional side view of the stratified scavenging two-cycle engine in FIG. 5 in a state in which it is near the bottom dead center.

The T-shaped channel 30, formed on the outer perimeter of the piston 3, connects with the air intake port 11, opened at the position which is lower than the scavenging ports 51 by the predetermined distance Lb, and connects the air intake port 11 to the two scavenging ports 51 at the time of an air intake stroke, thereby allowing air to be taken into the crank chamber 20 through the air intake port 11, the channel 30, and the two scavenging flow passages 50 (shown by the solid line arrow Y). At the time of a scavenging stroke, when the top portion of the piston 3 opens the scavenging port 51, the air intake port 11 is already closed, because the air intake port 11 is opened at the position which is lower than the scavenging ports 51 by the predetermined distance Lb toward the crankcase 20. For this reason, in the prior art a back-flow is prevented by means of a lead valve 80; but in the present invention the piston 3 closes the air intake port 11 to thereby prevent air or the mixture from flowing back to an air flow passage, thus making the lead valve 80 unnecessary. Further, since the width Ba of the opening of the scavenging port 51 is smaller than the predetermined distance La by which the air intake port 11 and the mixture intake port 12 are separated, when the T-shaped channel 30 is opened to the mixture intake port 12 at the lower position, an end portion 30*a* of the channel 30 does not connect with the scavenging port 51, whereby the scavenging port 51 is closed by the piston 3 as shown in FIG. 6. Accordingly, at the time of an intake stroke, the mixture does not flow into the scavenging flow passage 50 through the channel 30. As described above, the channel 30 is in a state in which the air intake port 11 is disconnected from the two scavenging ports 51 at the time of the above scavenging stroke (a state in which the piston 3 is in a position which is lowered a little from its position in FIG. 6). Thereby air is prevented from flowing back to the air intake port 11, and the mixture intake port 12 is in a state in which it is disconnected from the scavenging ports 51.

In the above, the aforesaid air intake port 11 and the channel 30 compose the air flow passage for supplying air into the scavenging flow passages 50.

The mixture intake port 12 is formed almost in a rectangular form in the inner perimeter surface of the cylinder block 1, and is opened and closed by a skirt portion of the piston 3. The mixture intake port 12 opens at the time of an intake stroke in which the piston 3 ascends and the pressure inside the crank chamber 20 reduces, thereby allowing the mixture to be taken into the crank chamber 20 (shown by the dotted line arrow W (in FIG. 5)), and the mixture intake port 12 closes at the time of a scavenging stroke in which the piston 3 descends and the pressure inside the crank chamber 20 increases, thereby preventing the mixture from being blown back to a carburetor side. As a result, a lead valve for preventing the back-flow is not required when a mixture is supplied into the crank chamber 20.

Figure 2:
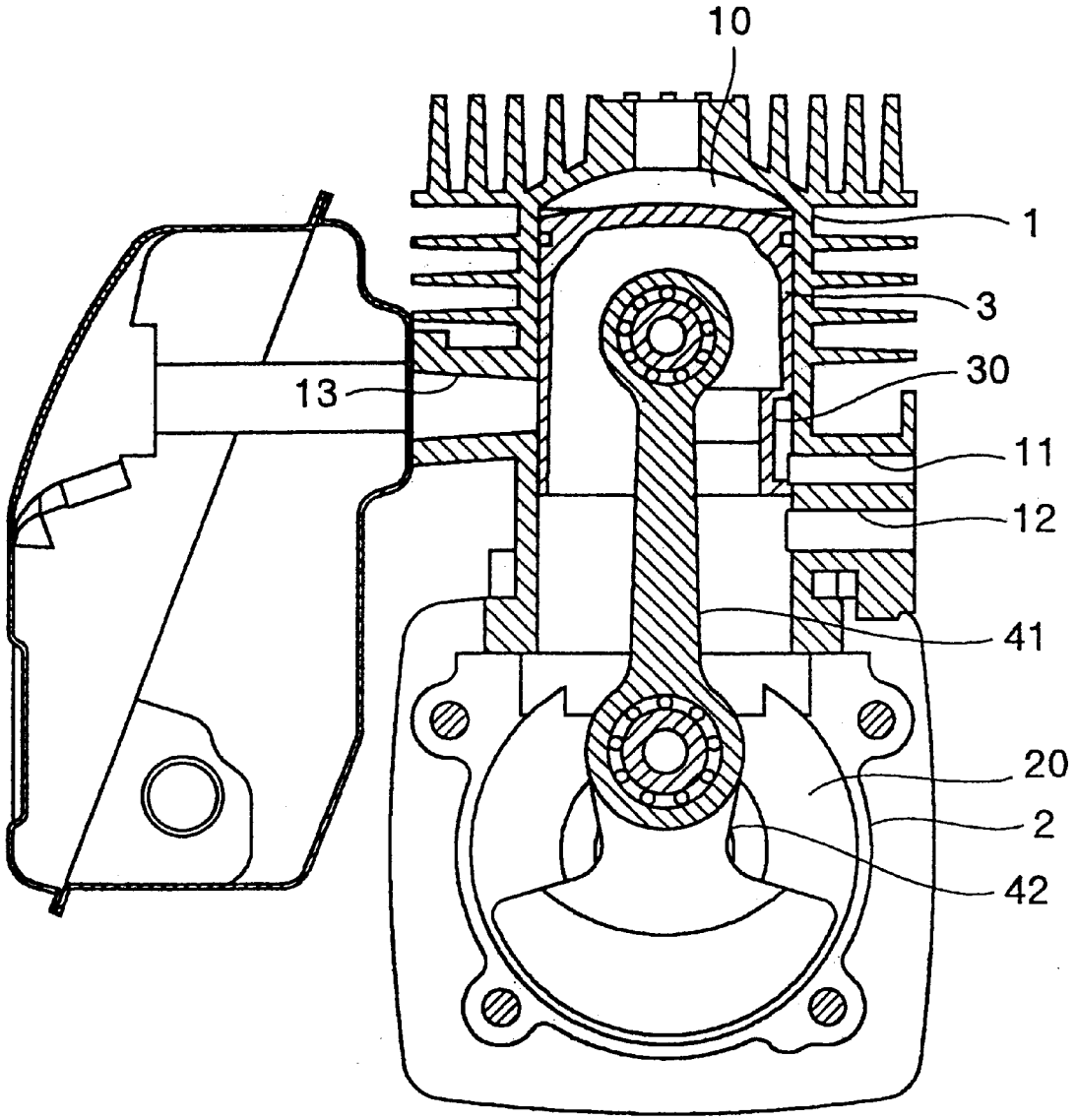
FIG. 2 is a sectional view of the stratified scavenging two-cycle engine of the first embodiment according to the present invention, showing a sectional view taken along the 2—2 line in FIG. 1.

Further, the cylinder block 1 is provided with an exhaust port 13 which is opened to the cylinder chamber 10 at a position higher than the scavenging ports 51 in the axial direction of the cylindrical chamber in the cylinder block 1, as shown in FIG. 2 and FIG. 6.

Figure 5:
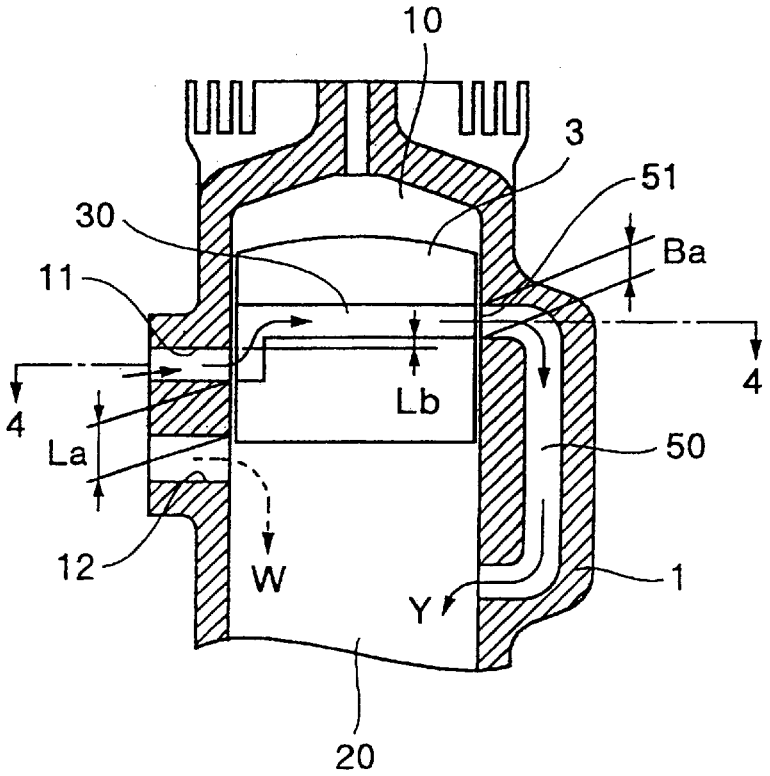
FIG. 5 is a sectional side view of the stratified scavenging two-cycle engine, which is near the top dead center, of the first embodiment according to the present invention, showing a sectional view taken along the 5—5 line in FIG. 4.

In the stratified scavenging two-cycle engine configured as above, as a result that the piston 3 ascends from the bottom dead center (the position near that shown in FIG. 6), the pressure in the crank chamber 20 starts to reduce while the pressure in the cylinder chamber 10 starts to rise, and the scavenging ports 51 and the exhaust port 13 close in order. In this situation, as shown in FIG. 5, in the position near the lower position of the top dead center, the air intake port 11 is in a state in which it is connected to the scavenging flow passages 50 via the channel 30 and the scavenging ports 51, and the mixture intake port 12 is open to the crank chamber 20. As a result, air is absorbed into the crank chamber 20 from the air intake port 11 through the channel 30 and the scavenging flow passages 50. In this situation, the mixture still remaining in the scavenging flow passages 50 is swept into the crank chamber 20 by the air, and thus the scavenging flow passages 50 are filled with air.

When the piston 3 further ascends and reaches the vicinity of the top dead center, the mixture in the cylinder chamber 10 is ignited to explode, whereby the piston 3 starts to descend. The pressure in the crank chamber 20 then starts to rise, with the channel 30 being shut to the air intake port 11 and the scavenging port 51, and with the mixture intake port 12 being closed by the piston 3, the piston 3 descends, thereby increasing the pressure in the crank chamber 20. In this situation, even if the pressure in the crank chamber 20 rises, the air in the scavenging flow passages 50 is not blown back to the air intake port 11 side, and the mixture in the crank chamber 20 is not blown back to the carburetor side.

Further, during the descent of the piston 3, the exhaust port 13 and the scavenging ports 51 are opened to the cylinder chamber 10 in order, and initially, combustion gas is discharged from the exhaust port 13. Subsequently, when the scavenging ports 51 are opened to the cylinder chamber 10, the air remaining in the scavenging flow passages 50 bursts out into the cylinder chamber 10 due to the increased pressure in the crank chamber 20. Thereby, the residual combustion gas in the cylinder chamber 10 is expelled into the atmosphere from the exhaust port 13 via a muffler. Subsequently, the mixture in the crank chamber 20 is charged into the cylinder chamber 10 through the scavenging flow passages 50.

Again, the piston 3 starts to ascend from the bottom dead center to thereby start to reduce the pressure in the crank chamber 20 to close the scavenging ports 51 and the exhaust port 13 in order, thus repeating the above cycle once again.

Accordingly, the lead valve conventionally used for taking air into the scavenging flow passages 50 is not required, thereby making it possible to reduce the intake resistance of air and the number of components. Since the channel 30 is connected to the scavenging ports 51 when air is taken in, the mixture is prevented from remaining in the scavenging flow passages 50. Consequently, in the exhaust stroke, unlike the situation in which the lead valve is used as in the prior art, the combustion gas remaining in the cylinder chamber 10 can be expelled into the atmosphere by the air filling the scavenging flow passages 50, thus preventing the mixture from being emitted into the atmosphere. Further, the channel 30 can be simultaneously formed when the piston 3 is manufactured by casting, and thereby providing the channel 30 does not increase a burden, for example, in the manufacturing thereof.

In addition, since the lead valve is not used, failures relating to the lead valve are eliminated, thus making it possible to increase reliability. Further, the space for placing the lead valve is not needed, thereby making it easy to reduce the size. Furthermore, timing for introducing air can be controlled by means of the channel 30 provided in the piston 3, thereby making it possible to facilitate the optimization of the quantity of air and mixture.

Figure 7:
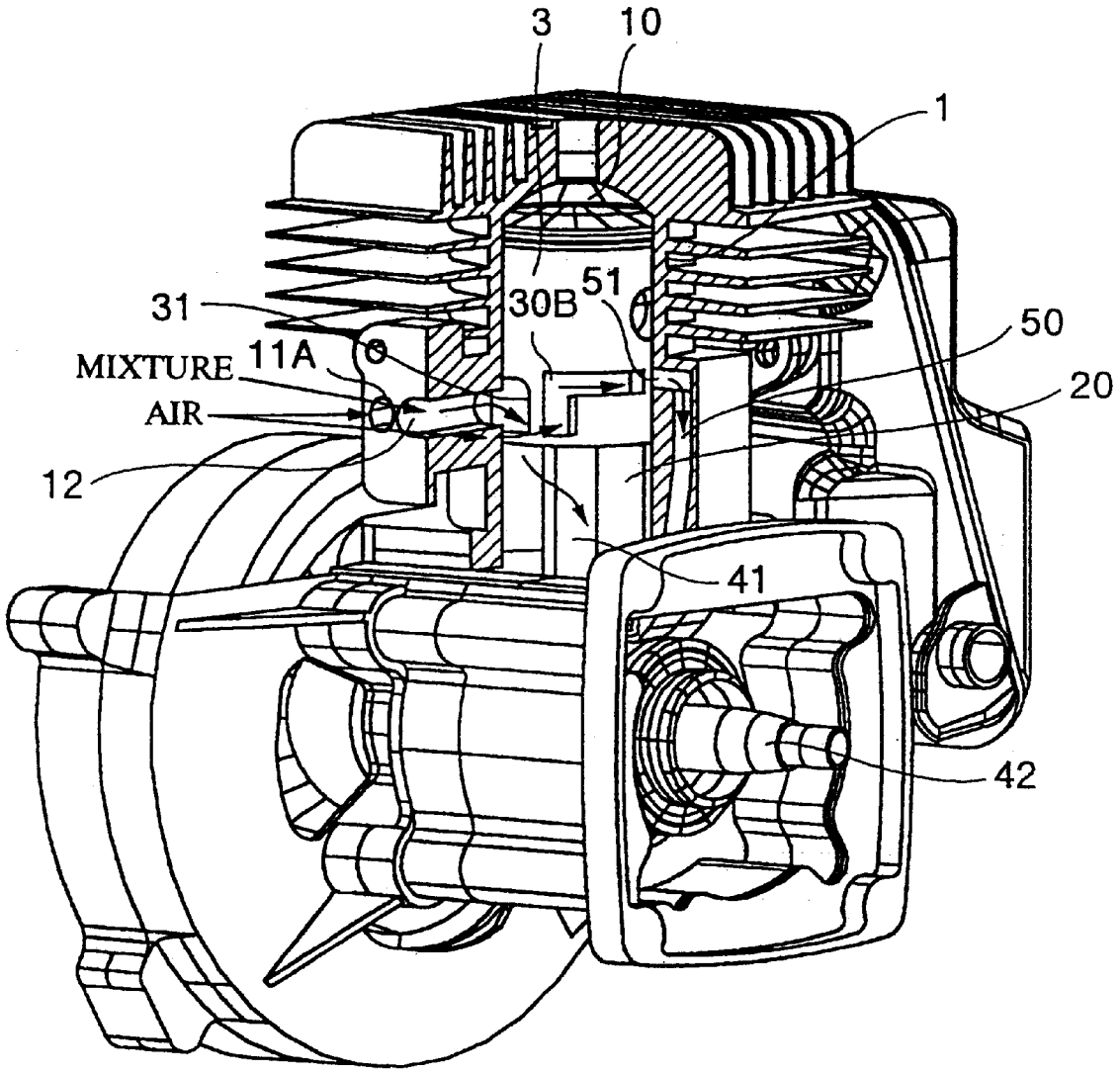
FIG. 7 is a partially cutaway perspective view of a stratified scavenging two-cycle engine of a second embodiment according to the present invention.
Figure 8:
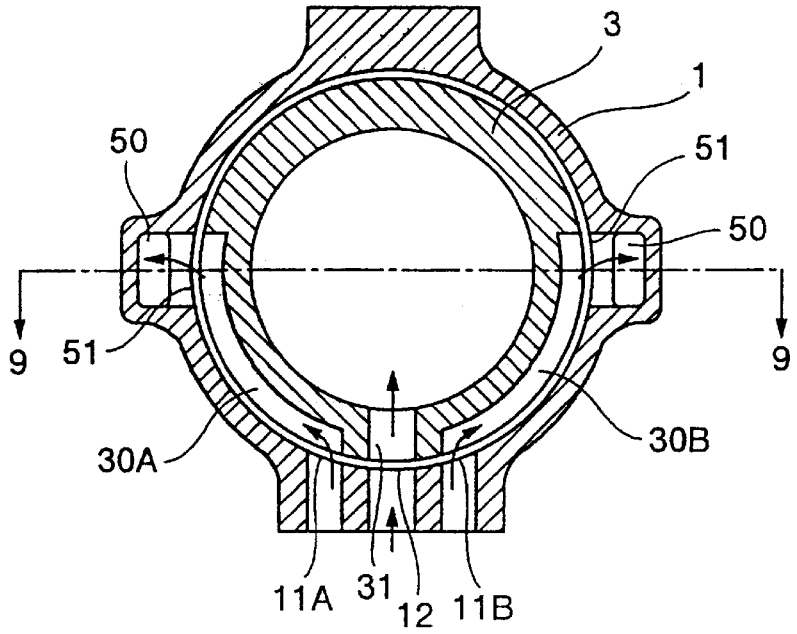
FIG. 8 is a sectional plan view of the stratified scavenging two-cycle engine of the second embodiment according to the present invention, showing a sectional view taken along the 8—8 line in FIG. 9.
Figure 9:
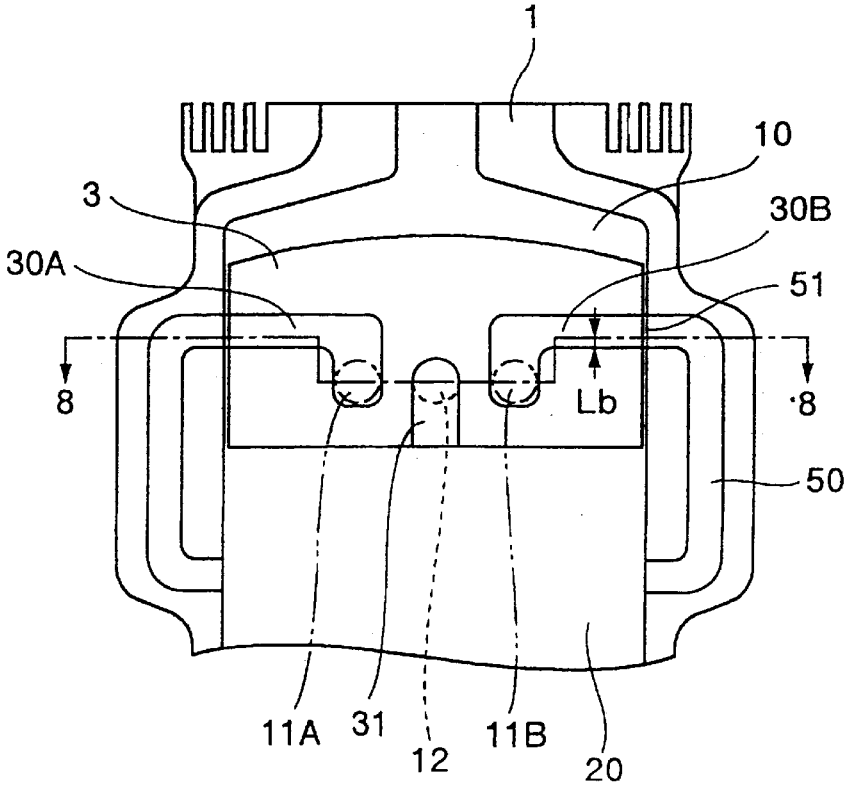
FIG. 9 is a sectional side view of the stratified scavenging two-cycle engine, which is near the top dead center, of the second embodiment according to the present invention, showing a sectional view taken along the 9—9 line in FIG. 8.

Next, a second embodiment of the present invention will be explained with reference to FIG. 7, FIG. 8, and FIG. 9. It should be noted that the elements common to those in the above first embodiment will be given the same numerals and symbols, and the explanation thereof will be omitted. A point in which the second embodiment differs from the first embodiment is that in the first embodiment, the air intake port 11 and the mixture intake port 12 are vertically arranged, but in the second embodiment, two of air intake ports 11A and 11B are positioned laterally with the mixture intake port 12 between them. As in the first embodiment, the positions, at which the air intake ports 11A and 11B are opened, are lower than the positions at which the scavenging ports 51 are opened by the predetermined distance Lb parallel to the axial direction of the cylindrical chamber in the cylinder block 1 as shown in FIG. 9. The positions, at which the scavenging ports 51 are opened, are displaced by the angle of 90 degrees respectively in the circumferential direction as shown in FIG. 8, as in the first embodiment. A through-hole 31 for the mixture is formed in the piston 3, and two L-shaped channels 30A and 30B for air are also formed therein at symmetrical positions with the through-hole 31 between them. The mixture intake port 12 is connected to the crank chamber 20 in the intake stroke via the through-hole 31 provided in the piston 3. The two left and right air intake ports 11A and 11B are connected in the intake stroke to the L-shaped channels 30A and 30B, respectively extending to the left and right along the outer perimeter of the piston 3.

In the stratified scavenging two-cycle engine configured as above, the same operational effects as in the aforesaid first embodiment are provided.

Figure 10:
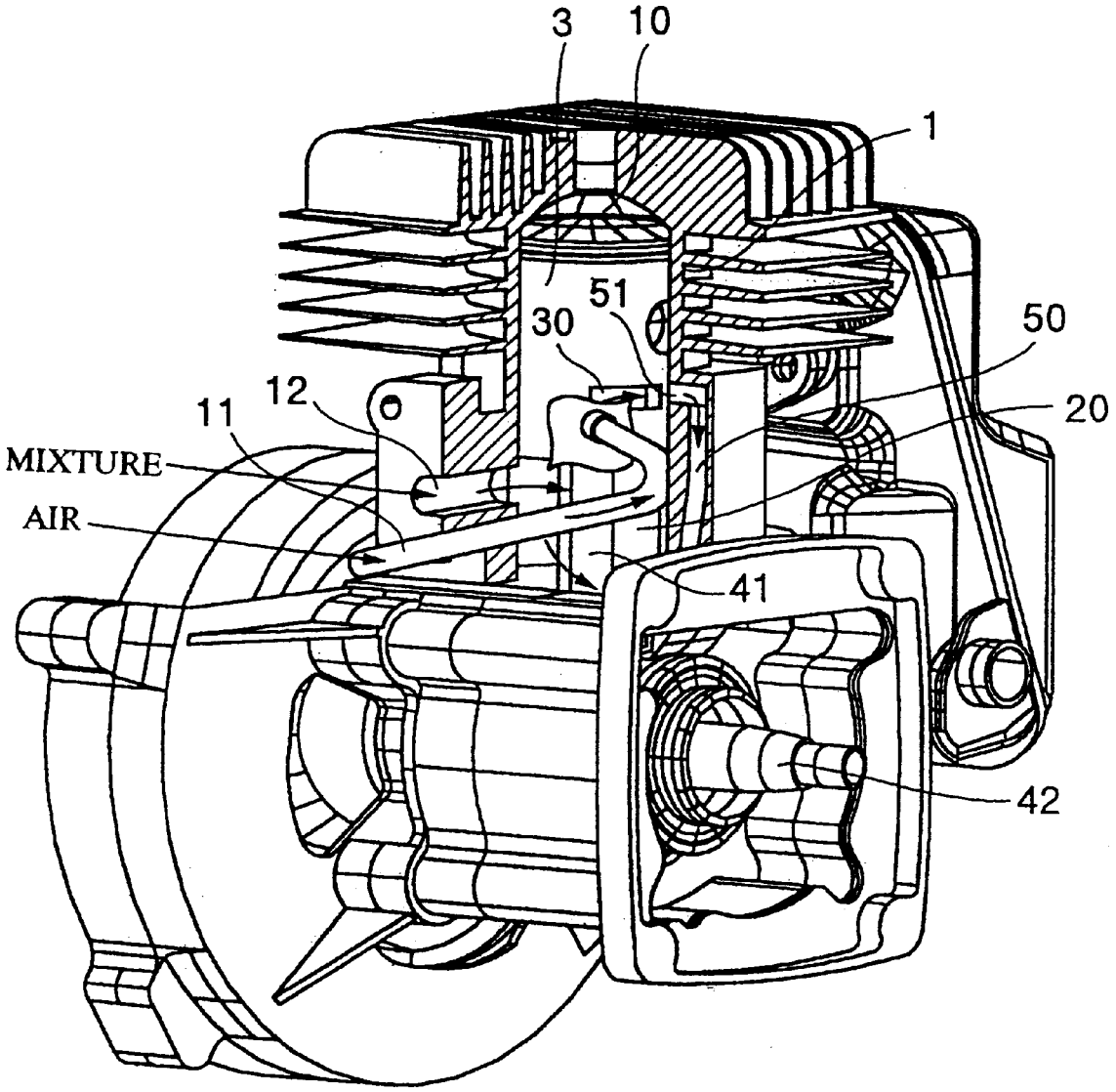
FIG. 10 is a partially cutaway perspective view of a stratified scavenging two-cycle engine of a third embodiment according to the present invention.

Next, a third embodiment of the present invention will be explained with reference to FIG. 10. It should be noted that the elements common to those in the aforesaid first embodiment will be given the same numerals and symbols, and the explanation thereof will be omitted. A point in which the third embodiment differs from the first embodiment is that in the first embodiment, the air intake port 11 and the mixture intake port 12 are vertically arranged, but in the third embodiment, the air intake port 11 is constructed by piping. The air intake port 11 is placed at a position which is lower by the predetermined distance Lb, than the positions at which the scavenging ports 51 are opened, and is connected to the channel 30 which extends laterally along the outer perimeter of the piston 3. Accordingly, the air intake port 11 can be provided at any position in the circumferential direction.

In the stratified scavenging two-cycle engine configured as above, the same operational effects as in the aforesaid first embodiment are provided.

Figure 11:
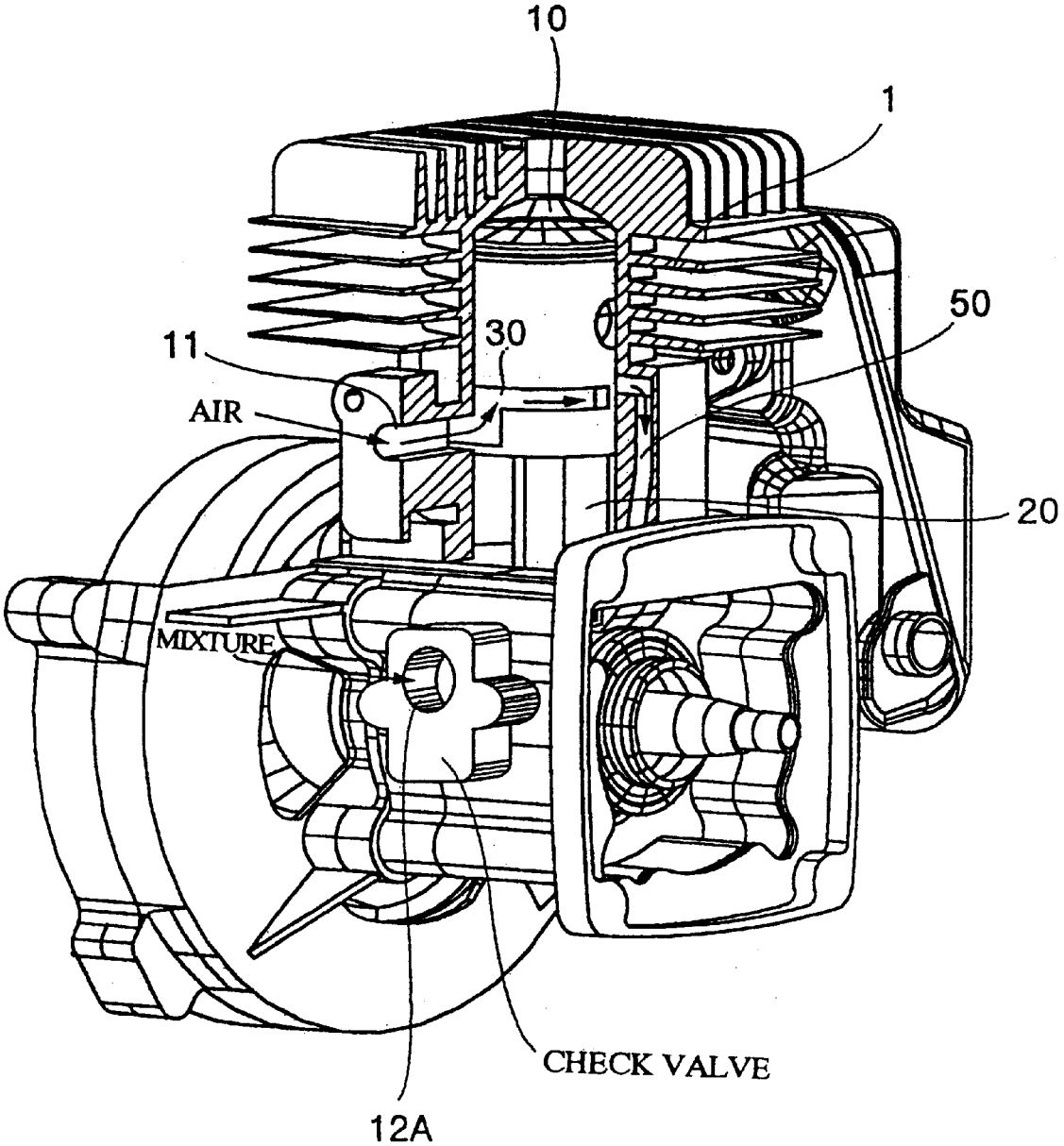
FIG. 11 is a partially cutaway perspective view of a stratified scavenging two-cycle engine of a fourth embodiment according to the present invention.
Figure 12:
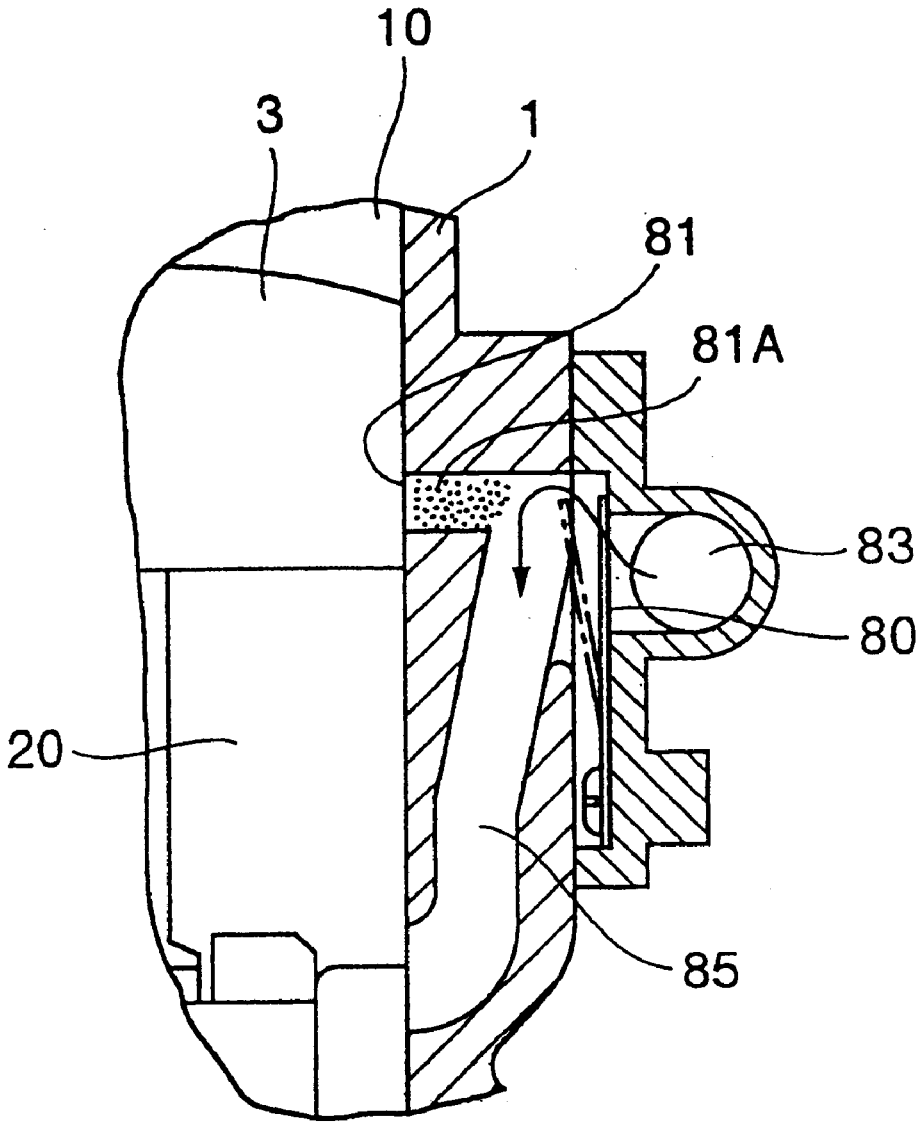
FIG.12 PRIOR ART
FIG. 12 is a partial sectional view of a conventional stratified scavenging two-cycle engine, showing a sectional view of a lead valve element provided at an air flow passage and a scavenging flow passage.

Next, a fourth embodiment of the present invention will be explained with reference to FIG. 11. It should be noted that the elements common to the aforesaid third embodiment will be given the same numerals and symbols, and the explanation thereof will be omitted. A point in which the fourth embodiment differs from the first embodiment is that in the first embodiment, the air intake port 11 and the mixture intake port 12 are vertically arranged, and the mixture intake port 12 is opened and closed by the piston 3, but in the fourth embodiment, a mixture intake port 12A is directly connected to the crank chamber 20, and the back-flow of the supplied mixture is controlled by the known lead valve (the check valve) not illustrated.

In the stratified scavenging two-cycle engine configured as above, the same operational effects as in the aforesaid first embodiment are also provided.

In the stratified scavenging two-cycle engine configured as above, air can be supplied into the scavenging ports 51 via the channel 30 of the piston 3, thereby making it possible to fill at least the cylinder chamber 10 side of the scavenging flow passage 51 with air. It is preferable to push the combustion gas out by filling the scavenging flow passages 50 or part of the cylinder chamber 10 connecting to the scavenging flow passages 50. Consequently, in the scavenging stroke, the combustion gas in the cylinder chamber 10 can be initially scavenged by air, thus making it possible to prevent the mixture remaining in the scavenging flow passages 50 from discharging therefrom as in the case in which the conventional lead valve 80 is used.

In each of the above embodiments, the passage connecting the air intake port 11 and the scavenging ports 51 is composed of the channel 30, but this passage can be, for example, in the form of a hole which is constructed to penetrate the piston 3 to connect the air intake port 11 and the scavenging ports 51. Further, the passage (the channel 30) is constructed to connect to with the scavenging flow passages 50 via the scavenging ports 51, but the passage (the channel 30) can be constructed to connect with some mid-point in the scavenging flow passages 50.

INDUSTRIAL AVAILABILITY

The present invention is useful as a stratified scavenging two-cycle engine, which takes in a mixture and scavenging air separately, is capable of doing away with emission of the mixture into the atmosphere and reducing intake resistance of air, and is less expensive with the number of components being reduced.

What is claimed is:

1. A stratified scavenging two-cycle engine including a cylinder block having a cylinder chamber therein, said cylinder block having a sidewall which at least partially defines said cylinder chamber, said sidewall having therein an air intake port, at least one scavenging port, and an exhaust port, a mixture intake port for communication with a crank chamber, and at least one scavenging flow passage for connecting the cylinder chamber to the crank chamber, wherein each scavenging port is an opening in said sidewall at a first position, wherein the air intake port is an opening in said sidewall at a second position which is a predetermined distance away from said first position toward the crank chamber parallel to an axial direction of said cylinder chamber in said cylinder block such that a position of a piston at which said air intake port is opened by movement of said piston is lower than a position of said piston at which said at least one scavenging port is opened by movement of said piston, and wherein the at least one scavenging port is connected to the air intake port through a piston to thereby supply air from the air intake port opening in said sidewall via the piston to and through each scavenging port opening to a scavenging flow passage at the time of an intake stroke.

2. A stratified scavenging two-cycle engine including an air intake port, scavenging ports, and an exhaust port which are connected to a cylinder chamber of the engine, a mixture intake port for communication with a crank chamber, and scavenging flow passages for connecting the cylinder chamber to the crank chamber, wherein the air intake port is provided at a position which is a predetermined distance away from the scavenging ports toward the crank chamber parallel to an axial direction of the cylinder chamber in a cylinder block, and the scavenging ports are connected to the air intake port through a piston to thereby supply air to the scavenging flow passages from the air intake port through the scavenging ports at the time of an intake stroke, wherein the piston has a channel in the outer perimeter thereof, and the channel connects the scavenging ports to the air intake port and disconnects the mixture intake port from the scavenging ports, at the time of an intake stroke.

3. A stratified scavenging two-cycle engine in accordance with claim 2, wherein the mixture intake port is opened and closed by the piston.

4. A stratified scavenging two-cycle engine including an air intake port, scavenging ports, and an exhaust port which are connected to a cylinder chamber of the engine, a mixture intake port for communication with a crank chamber, and scavenging flow passages for connecting the cylinder chamber to the crank chamber, wherein the air intake port is provided at a position which is a predetermined distance away from the scavenging ports toward the crank chamber parallel to an axial direction of the cylinder chamber in a cylinder block, and the scavenging ports are connected to the air intake port through a piston to thereby supply air to the scavenging flow passages from the air intake port through the scavenging ports at the time of an intake stroke, wherein the mixture intake port is opened and closed by the piston.

5. A stratified scavenging two-cycle engine comprising:

a cylinder block having a cylindrical chamber formed therein;

a crankcase connected to said cylinder block;

a piston slidably positioned in said cylindrical chamber; said piston and said cylinder block defining a cylinder chamber at one end of said piston; said piston, said cylinder block, and said crankcase defining a crank chamber at a second end of said piston;

wherein said cylinder block includes at least one air intake port, scavenging ports, and an exhaust port which are formed therein and which open to said cylindrical chamber;

wherein said engine has a mixture intake port for communication with said crank chamber;

wherein at least one of said cylinder block and said crankcase includes scavenging flow passages for connecting the cylinder chamber to the crank chamber wherein;

wherein said at least one air intake port is located in said cylinder block at a position which is a distance away from said scavenging ports in a direction toward said crank chamber which is parallel to an axial direction of said cylindrical chamber;

wherein said scavenging ports can be connected to said air intake port via said piston to thereby supply air from said air intake port through said scavenging ports to said scavenging flow passages during a time of an intake stroke; and wherein said mixture intake port is opened and closed by movement of said piston.

6. A stratified scavenging two-cycle engine comprising:

a cylinder block having a cylindrical chamber formed therein;

a crank case connected to said cylinder block;

a piston slidably positioned in said cylindrical chamber; said piston and said cylinder block defining a cylinder chamber at one end of said piston; said piston, said cylinder block, and said crankcase defining a crank chamber at a second end of said piston;

wherein said cylinder block includes at least one air intake port, scavenging ports, and an exhaust port which are formed therein and which open to said cylindrical chamber;

wherein said engine has a mixture intake port for communication with said crank chamber;

wherein at least one of said cylinder block and said crankcase includes scavenging flow passages for connecting the cylinder chamber to the crank chamber;

wherein said at least one air intake port is located in said cylinder block at a position which is a distance away from said scavenging ports in a direction toward said crank chamber which is parallel to an axial direction of said cylindrical chamber;

wherein said scavenging ports can be connected to said air intake port via said piston to thereby supply air from said air intake port through said scavenging ports to said scavenging flow passages during a time of an intake stroke; and wherein said piston has at least one channel formed in an outer perimeter of said piston, and wherein at a time of an intake stroke said at least one channel can connect said scavenging ports to said at least one air intake port and said piston can disconnect said mixture intake port from said scavenging ports.

7. A stratified scavenging two-cycle engine in accordance with claim 6, wherein said at least one air intake port comprises two air intake ports, wherein said piston has two channels formed in an outer perimeter of said piston, and wherein each of said channels can connect a respective one of said air intake ports to a respective one of said scavenging ports.

8. A stratified scavenging two-cycle engine in accordance with claim 6, wherein said mixture intake port is opened and closed by movement of said piston.

9. A stratified scavenging two-cycle engine in accordance with claim 8, wherein said at least one air intake port comprises two air intake ports, wherein said piston has two channels formed in an outer perimeter of said piston, and wherein each of said channels can connect a respective one of said air intake ports to a respective one of said scavenging ports.

10. A stratified scavenging two-cycle engine in accordance with claim 6, wherein said piston has a channel formed in an outer perimeter of said piston, said channel having a T-shape when viewed in a side view of said piston, and said channel extending around a portion of an outer periphery of said piston when viewed in a plan view of said piston, wherein at a time of an intake stroke said channel can connect said scavenging ports to said at least one air intake port and disconnect said mixture intake port from said scavenging ports.

11. A stratified scavenging two-cycle engine in accordance with claim 6, wherein said at least one air inlet port comprises two air inlet ports, and wherein said piston has two channels formed in an outer perimeter of said piston, each said channel having an L-shape when viewed in a side view of said piston, and each said channel extending around a portion of a periphery of said piston when viewed in a plan view of said piston, wherein at a time of an intake stroke each said channel can connect a respective one of said air intake ports to a respective scavenging port and disconnect said mixture intake port from said scavenging ports.

12. A stratified scavenging two-cycle engine comprising:

a cylinder block having a cylindrical chamber formed therein;

a crankcase connected to said cylinder block;

a piston slidably positioned in said cylindrical chamber; said piston and said cylinder block defining a cylinder chamber at one end of said piston; said piston, said cylinder block, and said crankcase defining a crank chamber at a second end of said piston;

wherein said cylinder block includes at least one air intake port, scavenging ports, and an exhaust port which are formed therein and which open to said cylindrical chamber;

wherein said engine has a mixture intake port for communication with said crank chamber;

wherein at least one of said cylinder block and said crankcase includes scavenging flow passages for connecting the cylinder chamber to the crank chamber;

wherein said at least one air intake port is located in said cylinder block at a position which is a distance away from said scavenging ports in a direction toward said crank chamber which is parallel to an axial direction of said cylindrical chamber;

wherein said scavenging ports can be connected to said air intake port via said piston to thereby supply air from said air intake port through said scavenging ports to said scavenging flow passages during a time of an intake stroke; and wherein a position at which an air intake port is opened by movement of said piston is lower than a position at which scavenging ports are opened by movement of said piston.

13. A stratified scavenging two-cycle engine in accordance with claim 12, wherein said distance, between said at least one air intake port and said scavenging ports in a direction toward said crank chamber which is parallel to an axial direction of said cylindrical chamber, is greater than an opening width of said scavenging ports parallel to said axial direction of said cylindrical chamber.

* * * * *

UNITED STATES PATENT AND TRADEMARK OFFICE

CERTIFICATE OF CORRECTION

PATENT NO. : 6,289,856 B1
DATED : September 18, 2001
INVENTOR(S) : Masanori Noguchi It is certified that error appears in the above-identified patent and that said Letters Patent is hereby corrected as shown below:

Title page,
Item "[73] Assignees:", delete "Komatsu Zenoah Co.,,", and insert -- Komatsu Zenoah Co., --.

Column 9,
Lines 38-40, delete "crank chamber wherein; wherein", and insert -- crank chamber; wherein --.
Line 57, delete "crank case", and insert -- crankcase --.

Signed and Sealed this

Twenty-first Day of May, 2002

*Attest:*

*Attesting Officer*

JAMES E. ROGAN
*Director of the United States Patent and Trademark Office*